US009540787B2

(12) United States Patent
West et al.

(10) Patent No.: US 9,540,787 B2
(45) Date of Patent: Jan. 10, 2017

(54) MOTOR GRADERS AND CIRCLE DRIVES ASSOCIATED WITH THE SAME

(71) Applicant: Deere & Company, Moline, IL (US)

(72) Inventors: Sean P. West, Dubuque, IA (US); Nathan J. Horstman, Durango, IA (US); Reginald M. Bindl, Dubuque, IA (US)

(73) Assignee: DEERE & COMPANY, Moline, IL (US)

( * ) Notice: Subject to any disclaimer, the term of this patent is extended or adjusted under 35 U.S.C. 154(b) by 6 days.

(21) Appl. No.: 14/515,294

(22) Filed: Oct. 15, 2014

(65) Prior Publication Data

US 2016/0108604 A1 Apr. 21, 2016

(51) Int. Cl.
*E02F 3/84* (2006.01)
*E02F 3/76* (2006.01)

(52) U.S. Cl.
CPC ..... *E02F 3/847* (2013.01); *E02F 3/764* (2013.01); *E02F 3/7668* (2013.01)

(58) Field of Classification Search
CPC ..... E02F 3/847; E02F 3/7668; E02F 3/764
See application file for complete search history.

(56) References Cited

U.S. PATENT DOCUMENTS 2,498,044 A 2/1950 Le Tourneau
4,053,016 A 10/1977 Stedman
4,154,481 A * 5/1979 Heckenhauer ..... E01C 23/088 172/484
6,028,524 A 2/2000 Hartman et al.
6,295,746 B1 10/2001 Meduna et al.
6,886,655 B2 5/2005 Varela et al.
7,874,377 B1 1/2011 Graeve
2008/0229626 A1 9/2008 Bertoni
2011/0186314 A1* 8/2011 Yoder ..... A01G 3/067 172/817
2012/0073890 A1 3/2012 Bindl et al.
2012/0130600 A1* 5/2012 Thomson ..... E02F 9/2025 701/50
2013/0240282 A1* 9/2013 Bindl ..... B60K 7/00 180/255
2015/0233094 A1* 8/2015 Maiyur ..... E02F 9/2246 701/50
2015/0259881 A1* 9/2015 Sharma ..... E02F 9/2033 701/50
2016/0024750 A1* 1/2016 Yoshimura ..... E02F 3/764 172/796

OTHER PUBLICATIONS

Zapi S.P.A., "AC-2 Flash Inverter," User Manual, 2006, 72 pages.

* cited by examiner

*Primary Examiner* — Basil T Jos
(74) *Attorney, Agent, or Firm* — Hanley, Flight & Zimmerman, LLC

(57) ABSTRACT

Motor graders and circle drives associated with the same. An example work vehicle includes a frame, a circle drive coupled to the frame, moldboard coupled to the circle drive and a planetary gear apparatus including an output shaft configured to mesh with the circle drive to rotate the circle drive relative to the frame.

24 Claims, 15 Drawing Sheets

MOTOR GRADERS AND CIRCLE DRIVES ASSOCIATED WITH THE SAME

FIELD OF THE DISCLOSURE

This disclosure relates generally to motor graders, and, more particularly, to motor graders and circle drives associated with the same.

BACKGROUND

Graders are used to create flat surfaces and/or roads during construction processes.

BRIEF DESCRIPTION OF THE DRAWINGS

The figures are not to scale. Wherever possible, the same reference numbers will be used throughout the drawing(s) and accompanying written description to refer to the same or like parts.

DETAILED DESCRIPTION

Figure 1:
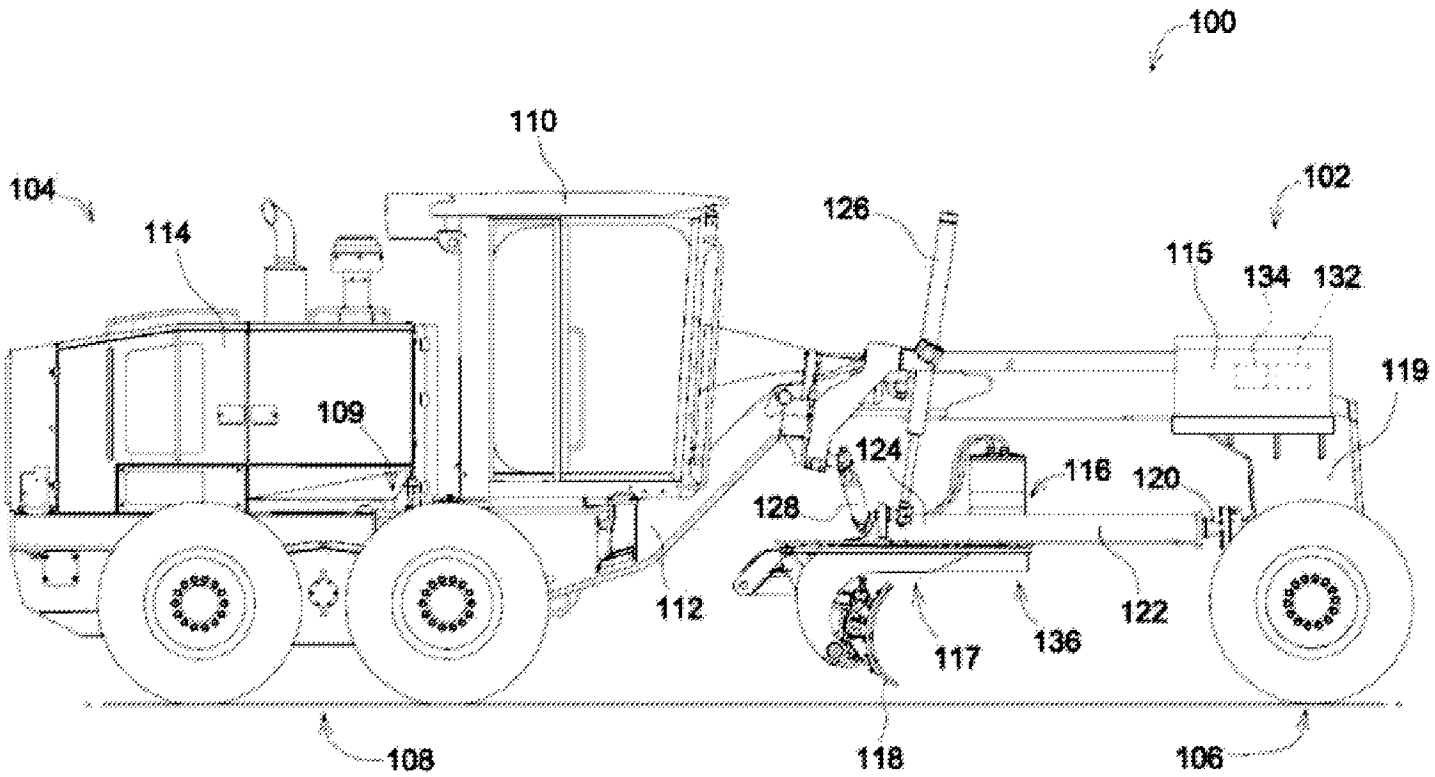
FIG. 1 shows an example motor grader in accordance with the examples disclosed herein.

The examples disclosed herein relate to graders and/or motor graders including a circle drive apparatus having an electric motor, hydraulic motor and/or planetary gear apparatus. In some examples, the circle drive apparatus and its related components are used to move a blade of the grader at high speeds and/or high torques depending on the operating condition and/or position of the blade.

For example, if it is determined that the blade is not engaging the ground, the electric motor may move the blade at a relatively high speed and a relatively low torque and/or if it is determined that the blade is engaging the ground, the electric motor may move the blade at a relatively low speed and a relatively high torque. Once the blade is in the desired position, the blade may be secured and/or locked in position by, for example, applying a stall current to the motor and/or applying a brake to an output shaft of the electric motor.

To move the blade from the secured and/or desired position, an amount of torque that is needed to smoothly move the blade after the brake is released is determined. Based on the determined torque value, a first motor current (e.g., value X) is provided to the motor and the torque output of the motor is monitored. When the torque output of the motor is equal to or substantially equal to the determined torque needed to smoothly move the blade, the brake is released and the blade is rotated clockwise or counterclockwise accordingly. To stop the blade in a first position using a stall current, a second motor current (e.g., value Y) is determined and then provided to the electric motor. To ensure that the motor does not degrade and/or to monitor the amount of torque being applied to the blade, the second current may be mapped to torque (e.g., torque on the blade, torque output of the motor) and, if it is determined that the temperature of the motor is adversely increasing and/or if the amount of torque on the blade increases above a predetermined amount, the brake may be applied to the output shaft.

To move the blade from the first position, an amount of torque to smoothly move the blade after the brake is released is determined. Based on the determined amount of torque, the second motor current (e.g., value Y) is provided to the motor and the torque output of the motor is monitored. When the torque output of the motor is equal to or substantially equal to the determined value, the brake is released and the blade is moved accordingly.

In some such examples, a battery and/or power system is used to power the electric motor. The battery and/or power system may be charged (e.g., trickle charged) using an electric system of the grader (e.g., a 24 volt system, 6 amps at 28 volts and/or providing a continuous electrical load). Thus, in the disclosed examples, the battery (e.g., 1 kWh battery, group 31 batteries and/or lithium batteries) and/or the power system accumulates power and/or energy over time and, when needed, powers the circle drive apparatus without substantially transient loading and/or using the electrical and/or hydraulic system capabilities of the grader. In some examples, the batteries may be a 8.8 kWh battery system that is operated at low voltage. However, the batteries may be implemented in any other configuration and/or operated at any voltage. In some examples, the battery may be implemented using capacitors or any other energy storage device.

FIG. 1 shows an example grader (e.g., a work vehicle) 100 including a first and/or front frame 102 and a second and/or rear frame 104. In the illustrated example, the front frame 102 is substantially supported by first and/or front wheels 106 and the rear frame 104 is substantially supported by rear wheels 108. In the illustrated example, the front frame 102 is pivotably coupled to the rear frame 104 via an articulation joint 109 to enable the grader 100 to be steered to the left and to the right. In the illustrated example, to provide an operator with a space to sit and/or for different controls to be positioned (e.g., steering wheel, lever assembly, etc.), an operator cab 110 is coupled to an inclined portion 112 of the front frame 102.

In the illustrated example, to supply driving power to the grader 100, an engine 114 is coupled to the rear frame 104. In some examples, the engine 114 supplies power to a transmission that drives the wheels 108 and/or to one or more batteries 115 via an alternator/generator. In the illustrated example, the batteries 115, via a motor assembly 116, are used to drive an example circle drive 117 and/or to move a blade (e.g., a moldboard) 118 in a number of directions (e.g., up, down, left, right, tilted, etc.) relative to the frames 102, 104. In the illustrated example, the batteries 115 are positioned adjacent an end 119 of the front frame 102 and may act as a counterbalance for the engine 114. However, in other examples, the batteries 115 may be adjacent the operator cab 110, the engine 114, the rear frame 104, etc. The motor assembly 116 may be implemented using an electrical motor, a hydraulic motor, etc. While FIG. 1 illustrates the grader 100 including the batteries 115, as discussed below, in examples in which the motor assembly 116 is implemented with a hydraulic motor, the batteries may not be included.

To couple the blade 118 to the frames 102, 104, a first or front end 120 of a drawbar 122 is pivotably coupled to the front frame 102 and a second or rear ends 124 of the drawbar 122 are coupled to the front frame 102 via actuators (e.g., hydraulic actuators, cylinders) 126, 128.

In the illustrated example, a processor 132 is positioned adjacent the batteries 115 and a cable (e.g., a three phase cable) couples the processor 132 and the motor assembly 116. In operation, the processor 132 determines and causes a particular current to be applied to the motor assembly 116, via an inverter 134. In this example, the processor 132 is coupled to the motor assembly 116 and the inverter 134. The current applied to the motor assembly 116 may maintain the blade 118 in a secured position and/or cause the blade 118 to move to a particular position based on an interaction between the motor assembly 116 and a circle and/or annular gear 136 of the circle drive 117. In some such examples, the processor 132 is used to control the motor assembly 116 based on a speed control (e.g., radians/second) and/or a torque limit.

Figure 2:
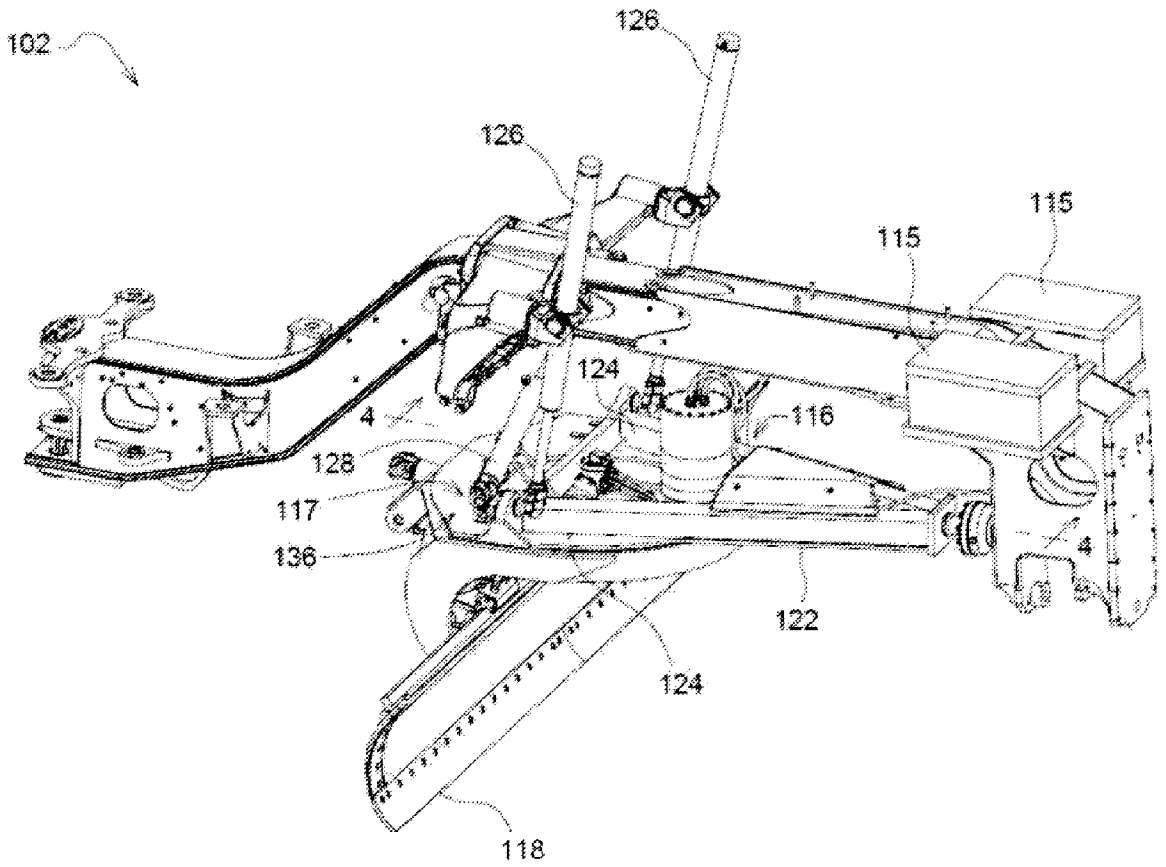
FIG. 2 shows a front portion of the example motor grader of FIG. 1 in accordance with the examples disclosed herein.

FIG. 2 shows an isometric view of the front frame 102 illustrating the coupling between the circle drive 117 and the rear ends 124 and illustrating the blade 118 extending from the circle drive 117.

Figure 3:
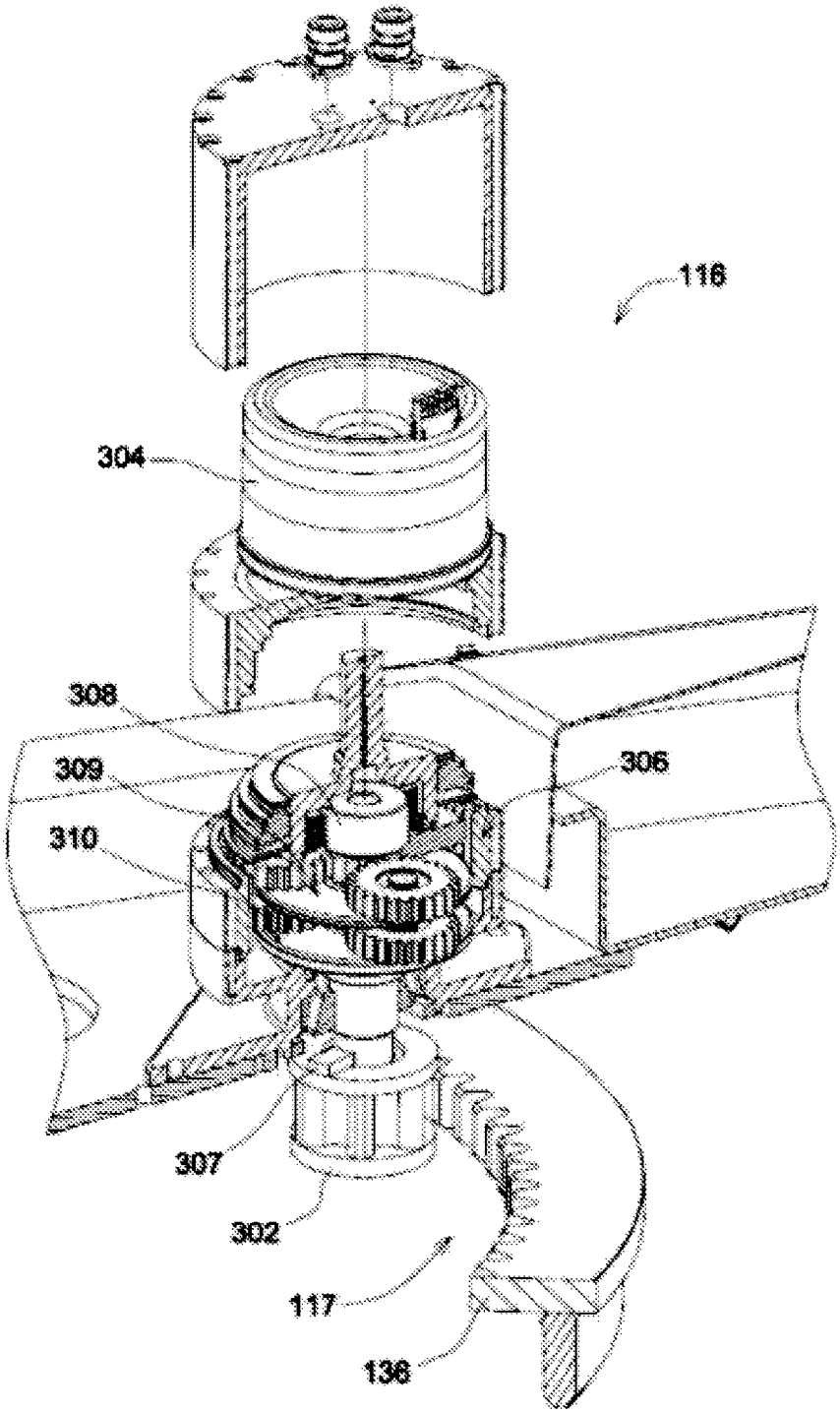
FIG. 3 shows an exploded, partial cross-sectional view of the front portion of FIG. 2.

FIG. 3 shows an exploded, partial cross-sectional view showing the coupling between a pinion 302 of the motor assembly 116 and the circle and/or annular gear 136 of the circle drive 117. To rotate the blade 118 (not shown in FIG. 3), in the illustrated example, the pinion 302, driven by an electric motor 304 of the motor assembly 116, engages and/or meshes with the annular gear 136 to rotate and/or move the circle drive 117 and the blade 118 clockwise or counter clockwise (e.g., bi-directional). In this example, the pinion 302 is part of a planetary gear assembly 306.

While the torque output of the electric motor 304 may be estimated using a look-up table that correlates the current provided to the electric motor 304 to the torque output (e.g., using mapping), in some examples, a sensor (e.g., a torque sensor) 307 is positioned on and/or adjacent the pinion 302 and is used to measure an amount of torque on the pinion 302, the blade 118 and/or an output torque of the electric motor 304. The sensor 307 may be any suitable sensor such as a torque transducer, a set of differential tone wheels, a load cell, etc. The sensor 307 may be positioned between the blade 118 and a brake 308 to enable a torque output of the electric motor 304 to be determined based on the current provided when the brake 308 is released. The sensor 307 may be positioned between the blade 118 and the brake 308 to enable a torque on the blade 118 and/or the pinion 302 to be determined when the brake 308 is applied. In some such examples, the sensor 307 may obtain torque readings while the grader 100 is operating to provide substantially continuous data in substantially real-time (e.g., traction control information, etc.). As used herein, the phrase "substantially real-time" accounts for any transmission delays based on, for example, communication mediums (e.g., wireless, wired, etc.).

Using the information received from the sensor 307 and/or based on the lookup table, if the amount of torque on the blade 118 exceeds a particular amount, the quality and/or the evenness of the grade of material being graded may decrease. Thus, the examples disclosed may automatically cause the speed of the grader 100 to decrease if the detected and/or measured torque on the blade 118 is higher than a predetermined threshold. While the sensor 307 is shown in a particular position on the pinion 302, a different number of sensors may be used (e.g., 2, 3, etc.) and the sensor 307 may be differently positioned to measure the amount of torque, stress and/or strain, etc. imparted on the blade 118. However, in other examples, the sensor 307 may not be included and, thus, the output torque of the electric motor 304 may be determined using the look-up table.

As shown in the example of FIG. 3, the planetary gear assembly 306 includes a first set of planetary gears 309 to provide a first gear reduction and a second set of planetary gears 310 to provide a second gear reduction. In some examples, the planetary gear assembly 306 provides a 500:1 gear ratio or any other suitable ratio to rotate the annular gear 136 at a substantially slower rate than the rotation of the electric motor 304. In other examples, the pinion 302 is directly coupled to the electric motor 304 (FIG. 3). Depending on the direction that the electric motor 304 is rotated (e.g., clockwise, counterclockwise), the blade 118 is moved and/or rotated either to the right or to the left relative to the frames 102, 104 (e.g., clockwise, counterclockwise). Specifically, to smoothly transition the blade 118, the processor 132 determines a current to apply to the electric motor 304 to generate adequate torque to move the blade 118. Based on the current determined, the current is applied to the electric motor 304 and the blade 118 is rotated accordingly.

In some examples, to secure the blade 118 in a desired position, the processor 132 determines a drive current to maintain the position of the electric motor 304 and/or the planetary gear assembly 306 in a stall condition (e.g., speed control=0 radian/second). If the processor 132 determines that the electric motor 304 has rotated from the desired position, in some examples, the processor 132 causes the inverter 134 to increase the current to the electric motor 304 to move the blade 118 back to a desired and/or a commanded position and/or the processor 132 causes the inverter 134 to increase the stall torque to the electric motor 304 substantially preventing further movement of the blade 118.

In the illustrated example, to ensure that the electric motor 304 does not overheat and/or degrade over time, an amount of stall current (e.g., a first stall current) applied to the blade 118 is monitored and/or mapped to a torque and, if the torque exceeds a particular amount, the brake 308 is applied to the pinion 302 to secure the blade 118 in the first desired position. In some examples, the current is mapped to the torque by testing the electric motor 304 and generating a map based on the amount of torque generated from magnetic flux and the current flowing though windings of the electric motor 304. The torque generated is based on the physical construction of the magnetic circuit of the electric motor 304.

In some examples, once the brake 308 is applied, the current applied to the electric motor 304 is reduced (e.g., zero current). However, because the current feedback is used to determine the torque output of the electric motor 304, when the brake 308 is applied, the processor 132 may not be able to determine the torque output of the electric motor 304.

Specifically, in some examples, when the brake 308 is applied, the stall torque of the electric motor 304 does not represent the torque on the blade 118 because the brake 308, and not the electric motor 304, is being used to retain the blade 118 in position. In such examples, the torque output of the electric motor 304 can be estimated using the look-up table and/or the torque on the blade 118 can be estimated using the sensor 307. However, the estimated torque may not correspond to the estimated output torque of the electric motor 304 on the blade 118 because of the brake 308, for example.

In the illustrated example, pulse-width-modulation (PWM) may be used to control the current to the electric motor 304 and/or the torque exerted thereon. In some examples, a gear ratio of the planetary gear assembly 306 and/or a position of the blade 118 can be used as an input(s) to determine a force on the blade 118 in substantially real time, to provide torque feedback and/or to determine the position of a rotor of the electric motor 304. For example, an estimate of the torque on the blade 118 can be determined using motor current. In some examples, a speed of the grader 100 may be optimized based on a tractive force (e.g., force in the forward direction) determined.

In some examples, the force on the blade 118 is based on an interaction between a cutting edge of the blade 118 and the soil. Thus, the position and/or rotation of the blade 118 can change an amount of force imparted on the blade 118. In some examples, a cylinder position sensor is used to determine a position (e.g., side-to-side position) of the blade 118. The use of real time torque feedback, as disclosed herein, enables the automation of certain grader functions. In the illustrated example, additional automation of the cutting depth for the right cylinder and/or the left cylinder 126 improves the drivetrain operation.

In the illustrated example, the processor 132 is used to determine the position of the blade 118 relative to the ground and, based on the determined position, the blade 118 may be moved at a high speed and/or at a high torque. In some examples, the position of the blade 118 and/or its position relative to a pivot point of the circle drive 117 is determined based on an amount of torque on and/or exerted by the electric motor 304 and/or an amount of stress and/or strain on the blade 118. In some examples, given that the minute arc (MOA) is a unit of angular measurement equal to approximately 1/60 of one degree (e.g., circle/21,600), the sensor (e.g., a rotation sensor, a current sensor, etc.) 307 may be used to determine an angle of the blade 118. For example, the sensor 307 can be used to determine a relatively precise blade angle measurement based on a fixed gear train and a calibration that relates a relative measurement of the blade 118 and a relatively absolute and/or accurate blade angle measurement.

In operation, in some examples, if the processor 132 determines that the blade 118 is not engaging the ground, the processor 132 causes the electric motor 304 to move the blade 118 at a relatively high speed and a relatively low torque. In some such examples, the processor 132 determines that the blade 118 is not engaging the ground based on a torque value received from the sensor 307 being lower than a predetermined value and/or based on a current value provided to the electric motor 304 to output a torque that moves the blade 118 being lower than a predetermined value. However, in other examples, if the processor 132 determines that the blade 118 is engaging the ground, the processor 132 causes the electric motor 304 to output a torque that moves the blade 118 at a relatively low speed and a relatively high torque. In some such examples, the processor 132 determines that the blade 118 is engaging the ground based on a torque value received from the sensor 307 being higher than a predetermined value and/or based on a current value provided to the electric motor 304 to move the blade 118 being above the predetermined value. In some examples, changing the position of the blade 118 when the blade 118 engages the ground changes an angle of the blade 118 relative to the frame 102, 104, for example.

While the examples illustrated in FIGS. 1, 2 and 3 show the grader 100 including the electric motor 304 and the batteries 115 to provide power to the electric motor 304, via the inverter 134, in other examples, the grader 100 may include a hydraulic motor coupled to the planetary gear assembly 306 or a planetary gear assembly having less of a gear reduction or any suitable gear reduction to move the blade 118. In some examples in which the grader 100 is implemented with a hydraulic motor, the grader 100 includes computer controlled hydraulics and one or more pressure sensors to substantially ensure rotation of the hydraulic motor is stopped when appropriate. In such examples, a hydraulic motor torque can be estimated based on the pressure of a hydraulic fluid applied to a fixed displacement pump.

Figure 4:
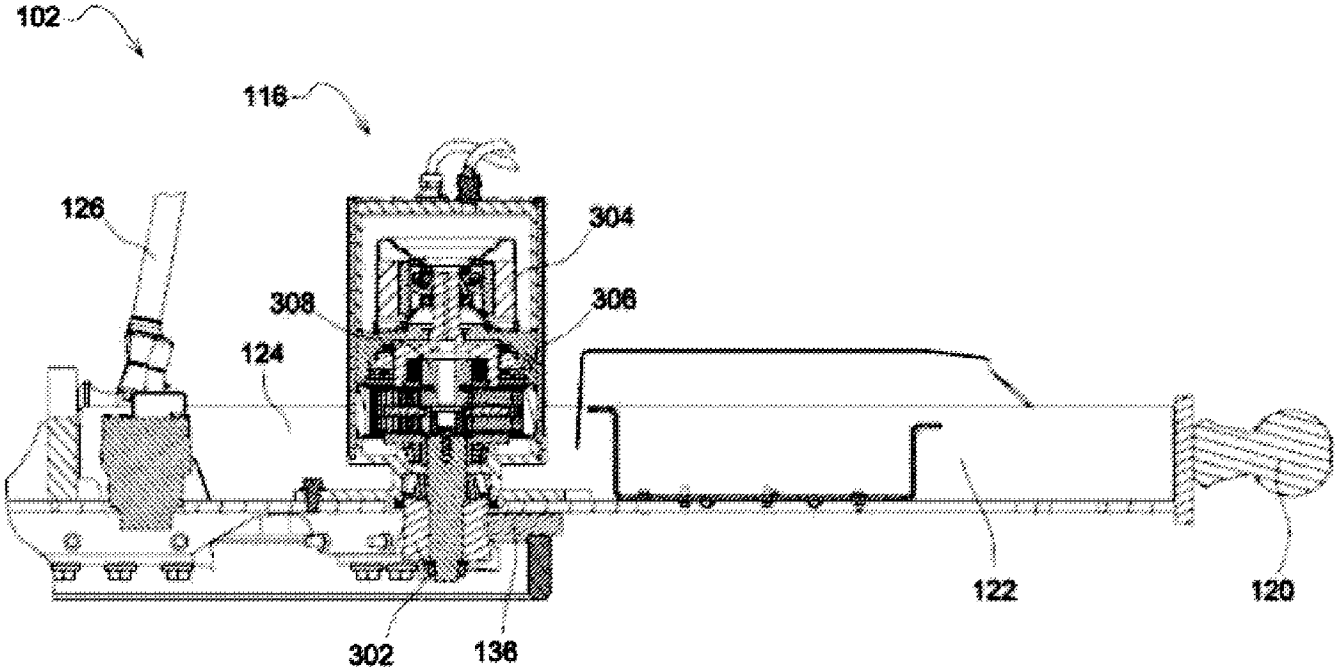
FIG. 4 shows a cross-sectional view of the front portion of FIG. 2 taken along line 4-4.

FIG. 4 shows a cross-sectional view of the front frame 102 illustrating the drawbar 122, the motor assembly 116, the pinion 302 and the annular gear 136. As shown in FIG. 4, the pinion 302 meshes with the annular gear 136.

Figure 5:
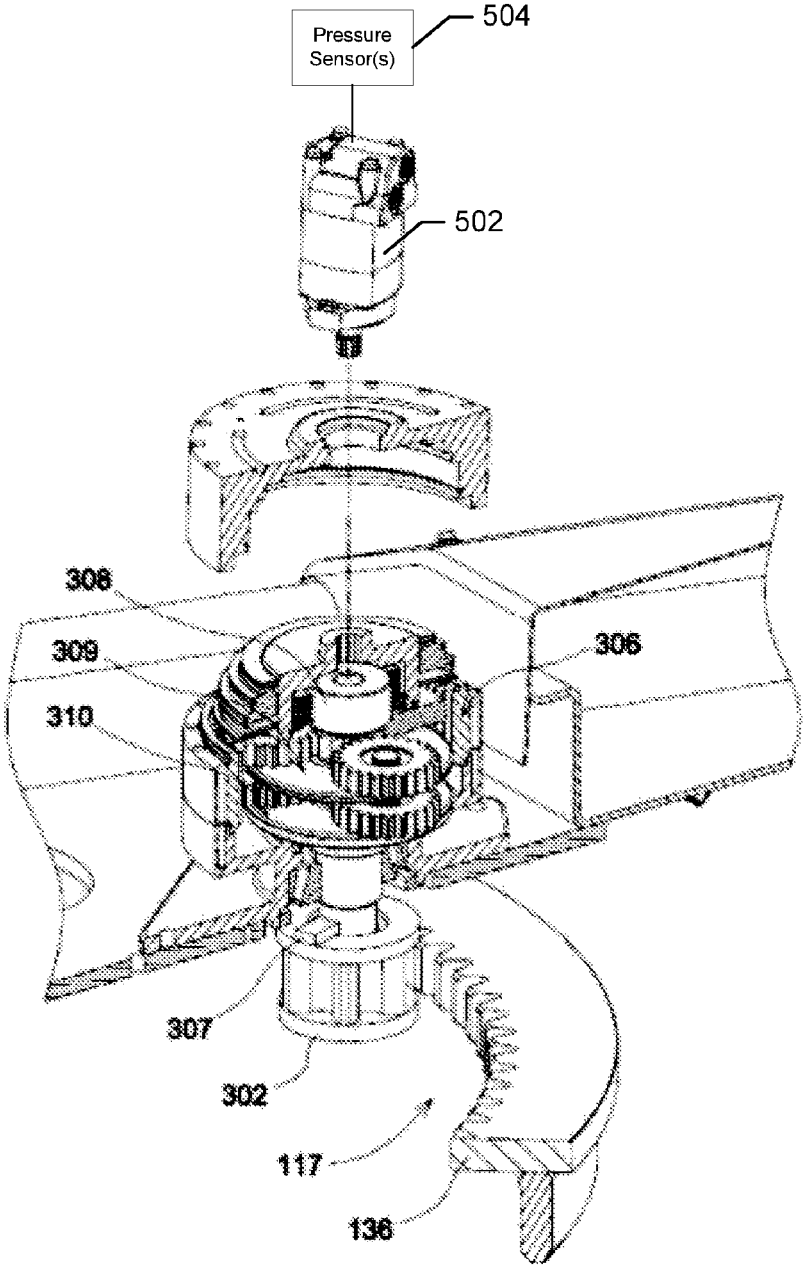
FIG. 5 shows an exploded, partial cross-sectional view of an alternative front portion that can be used to implement the example motor grader of FIG. 1.

FIG. 5 shows an exploded, partial cross-sectional view similar to the example shown in FIG. 3. However, in contrast to the example shown in FIG. 3, the example shown in FIG. 5 includes a hydraulic motor 502 instead of the electric motor 304. Thus, to rotate the blade 118 (not shown in FIG. 5), in the illustrated example, the pinion 302, driven by the hydraulic motor 502, engages and/or meshes with the annular gear 136 to rotate and/or move the circle drive 117 and the blade 118 clockwise or counter clockwise (e.g., bi-directional). In this example, a pressure sensor(s) 504 may be used to measure the pressure at the hydraulic motor 502 and the sensor 307 may be used to determine the torque on the blade 118.

In operation, the processor 132 determines if an input has been received associated with a circle rotate control being moved from a neutral position. Based on the movement of the circle rotate control from the neutral position, a valve is actuated which provides pressure (e.g., hydraulic pressure) to the hydraulic motor 502. Using information received from the sensor 307, the processor 132 determines a torque on the blade 118 and determines a pressure for the hydraulic motor 502 to move the blade 118. The pressure sensor(s) 504 measures the pressure at the hydraulic motor 502 and, based on the measured pressure and the torque on the blade 118, the processor 132 determines if the output torque of the hydraulic motor 502 is sufficient to control the blade 118. If the processor 132 determines that the output torque of the hydraulic motor 502 is sufficient to control the blade 118, the brake 308 is released to enable the blade 118 to be controlled by the hydraulic motor 502.

After the brake 308 is released and the hydraulic motor 502 is applying a torque to move the blade 118, the sensor 307 monitors the torque on the blade 118 and the processor 132 determines if the torque on the blade 118 is less than an estimated output torque of the hydraulic motor 502. The estimated output torque of the hydraulic motor 502 is based on the pressure measured by the pressure sensor(s) 504. If the torque on the blade 118 is greater than an estimated output torque of the hydraulic motor 502, the processor 132 causes the brake 308 to be applied. In some examples, after the brake 308 is applied, the operator moves the circle rotate control to the neutral position to reduce the hydraulic pressure to the hydraulic motor 502. However, if the torque on the blade 118 is less than an estimated output torque of the hydraulic motor 502, the hydraulic motor 502 continues to apply an output torque on the blade 118 to move the blade 118 in the desired direction. Once the processor 132 receives an input that the circle rotate control has been returned to a neutral position indicative that the blade 118 rotation should stop, the processor 132 causes the brake 308 to be applied and the hydraulic pressure to the hydraulic motor 502 decreases.

Figure 6:
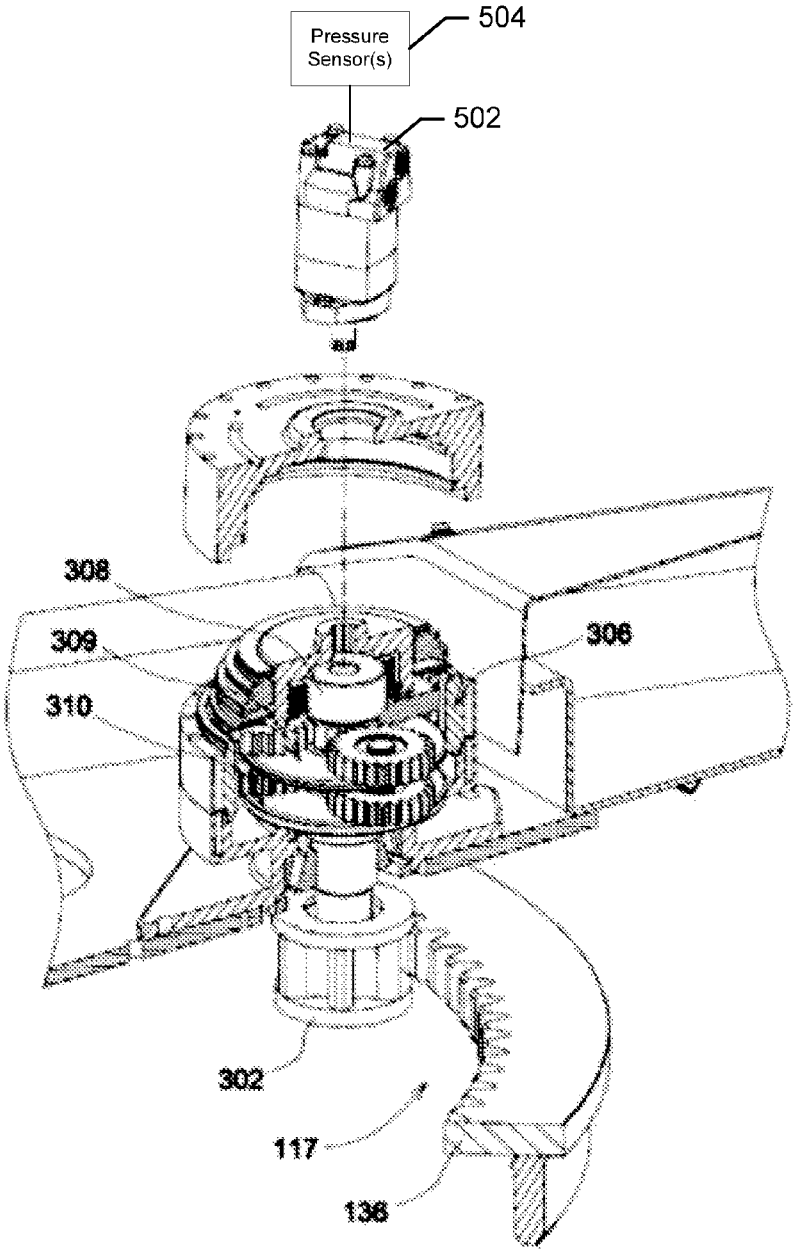
FIG. 6 shows an exploded, partial cross-sectional view of another alternative front portion that can be used to implement the example motor grader of FIG. 1.

FIG. 6 shows an exploded, partial cross-sectional view similar to the example shown in FIG. 5. However, in contrast to the example shown in FIG. 5, the example shown in FIG. 6 does not include the sensor 307.

In operation, the processor 132 determines if an input has been received associated with a circle rotate control being moved from a neutral position. Based on the movement of the circle rotate control from the neutral position, a valve is actuated which provides pressure (e.g., hydraulic pressure) to the hydraulic motor 502 and the brake 308 is released to enable the blade 118 to be controlled by the hydraulic motor 502.

The pressure sensor(s) 504 measures the pressure at the hydraulic motor 502 and, based on the measured pressure, the processor 132 determines if the measured pressure exceeds a particular threshold value (e.g., indication that the hydraulic motor 502 is being driven backwards). Having the measured pressure below the threshold value indicates that the hydraulic motor 502 may be able to control the movement of the blade 118. Having the measured pressure above the threshold value indicates that the hydraulic motor 502 may not be able to control the movement of the blade 118. If the measured pressure is greater than the threshold value, the processor 132 causes the brake 308 to be applied. In some examples, after the brake 308 is applied, the operator moves the circle rotate control to the neutral position to reduce the hydraulic pressure to the hydraulic motor 502. However, if the measured pressure is less than the threshold value, the hydraulic motor 502 continues to apply an output torque on the blade 118 to move the blade 118 in the desired direction. Once the processor 132 receives an input that the circle rotate control has been returned to a neutral position indicative that the blade 118 rotation should stop, the processor 132 causes the brake 308 to be applied and the hydraulic pressure to the hydraulic motor 502 decreases.

Figure 7:
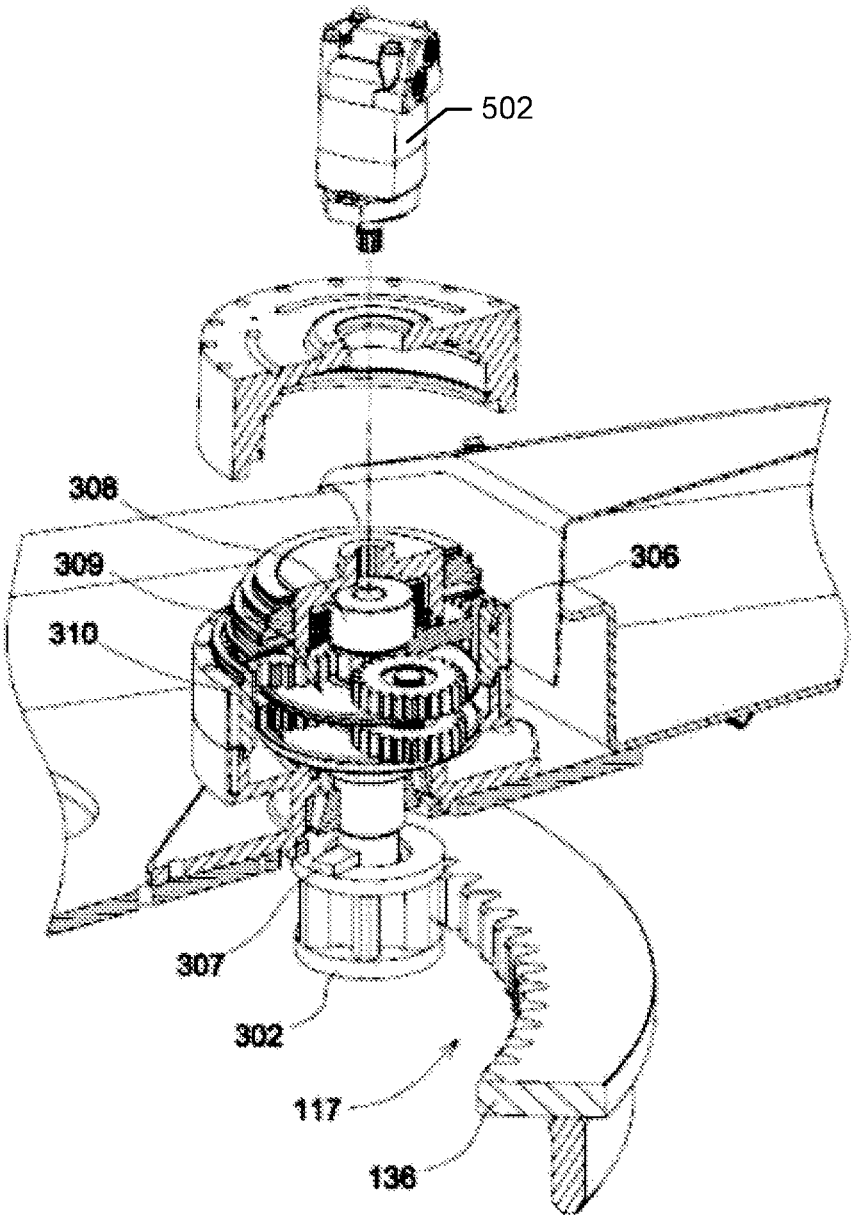
FIG. 7 shows an exploded, partial cross-sectional view of another alternative front portion that can be used to implement the example motor grader of FIG. 1.

FIG. 7 shows an exploded, partial cross-sectional view similar to the example shown in FIG. 5. However, in contrast to the example shown in FIG. 5, the example shown in FIG. 7 does not include the pressure sensor(s) 504.

In operation, the processor 132 determines if an input has been received associated with a circle rotate control being moved from a neutral position. Based on the movement of the circle rotate control from the neutral position, a valve is actuated which provides pressure (e.g., hydraulic pressure) to the hydraulic motor 502. Using information received from the sensor 307, the processor 132 determines a torque on the blade 118 and determines a pressure for the hydraulic motor 502 to move the blade 118. Based on the hydraulic pressure within the hydraulic system of the grader 100, the processor 132 determines if the output torque of the hydraulic motor 502 is sufficient to control the blade 118. If the processor 132 determines that the output torque of the hydraulic motor 502 is sufficient to control the blade 118, the brake 308 is released to enable the blade 118 to be controlled by the hydraulic motor 502.

After the brake 308 is released and the hydraulic motor 502 is applying a torque to move the blade 118, the sensor 307 monitors the torque on the blade 118 and the processor 132 determines if the torque on the blade 118 is less than an estimated output torque of the hydraulic motor 502 based on the hydraulic pressure within the hydraulic system of the grader 100. If the torque on the blade 118 is greater than an estimated output torque of the hydraulic motor 502, the processor 132 causes the brake 308 to be applied. In some examples, after the brake 308 is applied, the operator moves the circle rotate control to the neutral position to reduce the hydraulic pressure to the hydraulic motor 502. However, if the torque on the blade 118 is less than an estimated output torque of the hydraulic motor 502, the hydraulic motor 502 continues to apply an output torque on the blade 118 to move the blade 118 in the desired direction. Once the processor 132 receives an input that the circle rotate control has been returned to a neutral position indicative that the blade 118 rotation should stop, the processor 132 causes the brake 308 to be applied and the hydraulic pressure to the hydraulic motor 502 decreases.

Figure 8:
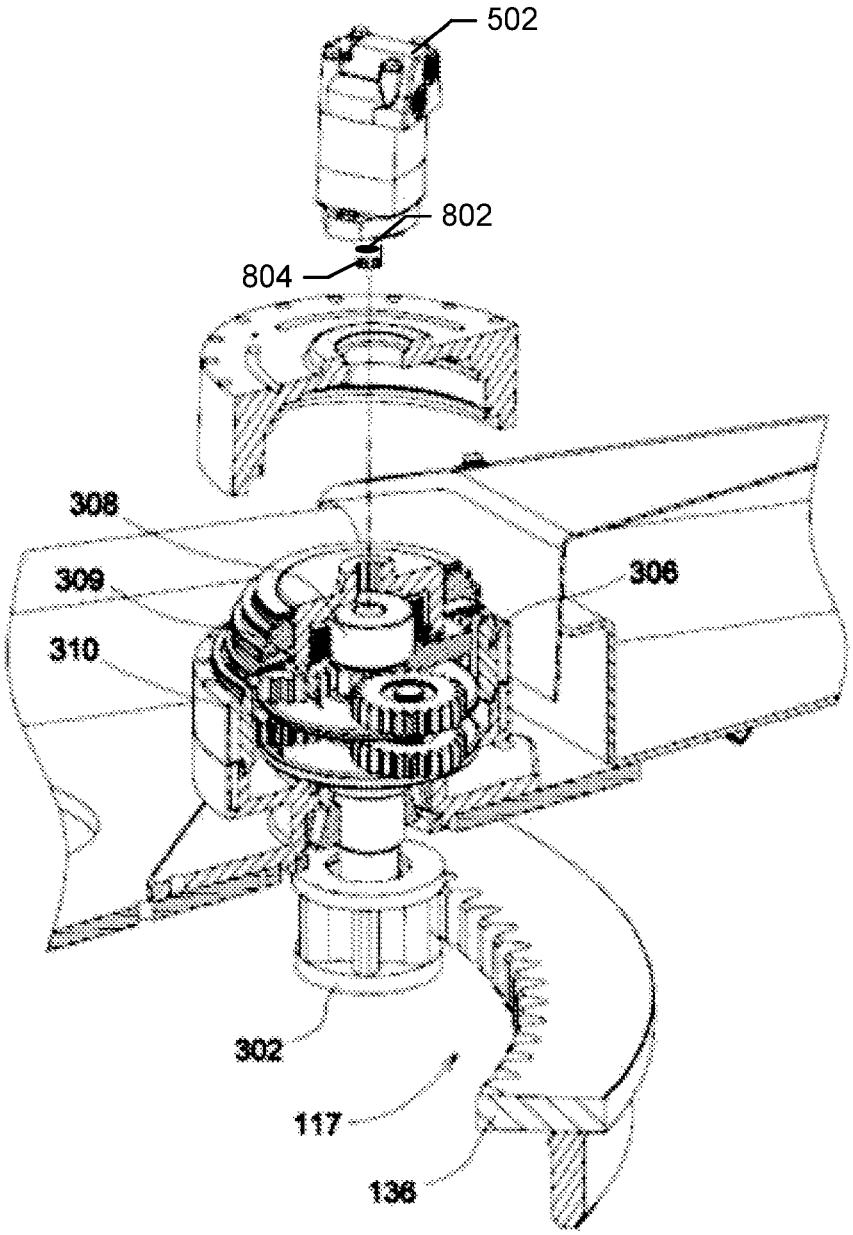
FIG. 8 shows an exploded, partial cross-sectional view of another alternative front portion that can be used to implement the example motor grader of FIG. 1.

FIG. 8 shows an exploded, partial cross-sectional view similar to the example shown in FIG. 5. However, in contrast to the example shown in FIG. 5, the example shown in FIG. 8 includes a speed sensor 802 coupled to an output shaft 804. In this example, the speed sensor 802 may be used to measure the rotational direction of the blade 118.

In operation, the processor 132 determines if an input has been received associated with a circle rotate control being moved from a neutral position indicating that the blade 118 should move in a particular direction (e.g. clockwise, counterclockwise). Based on the movement of the circle rotate control from the neutral position, a valve is actuated which provides pressure (e.g., hydraulic pressure) to the hydraulic motor 502 and the brake 308 is released to enable the blade 118 to be controlled by the hydraulic motor 502.

The speed sensor 802 then monitors the direction of the blade 118 and, based on feedback received from the speed sensor 802, the processor 132 determines if the blade 118 is rotating in the intended direction. The direction that the operator intends to have the blade 118 rotate is based on the input received from the circle rotate control. If the blade 118 is moving in the intended direction, the hydraulic motor 502 continues to apply an output torque on the blade 118 to move the blade 118 in the desired direction. However, if the blade 118 is not moving in the intended direction, the processor 132 causes the brake 308 to be applied. In some examples, after the brake 308 is applied, the operator moves the circle rotate control to the neutral position to reduce the hydraulic pressure to the hydraulic motor 502. Once the processor 132 receives an input that a circle rotate control has been returned to a neutral position indicative that the blade 118 rotation should stop, the processor 132 causes the brake 308 to be applied and the hydraulic pressure to the hydraulic motor 502 decreases.

A flowchart representative of example machine readable instructions for implementing the grader 100 and its related components of FIGS. 1-8 is shown in FIGS. 9-14. In this example, the machine readable instructions comprise a program for execution by a processor such as the processor 1112 shown in the example processor platform 1100 discussed below in connection with FIG. 15.

The program may be embodied in software stored on a tangible computer readable storage medium such as a CD-ROM, a floppy disk, a hard drive, a digital versatile disk (DVD), a Blu-ray disk, or a memory associated with the processor 1112, but the entire program and/or parts thereof could alternatively be executed by a device other than the processor 1112 and/or embodied in firmware or dedicated hardware. Further, although the example program is described with reference to the flowchart illustrated in FIGS. 9-14, many other methods of implementing the example grader 100 may alternatively be used. For example, the order of execution of the blocks may be changed, and/or some of the blocks described may be changed, eliminated, or combined.

As mentioned above, the example processes of FIGS. 9-14 may be implemented using coded instructions (e.g., computer and/or machine readable instructions) stored on a tangible computer readable storage medium such as a hard disk drive, a flash memory, a read-only memory (ROM), a compact disk (CD), a digital versatile disk (DVD), a cache, a random-access memory (RAM) and/or any other storage device or storage disk in which information is stored for any duration (e.g., for extended time periods, permanently, for brief instances, for temporarily buffering, and/or for caching of the information). As used herein, the term tangible computer readable storage medium is expressly defined to include any type of computer readable storage device and/or storage disk and to exclude propagating signals and to exclude transmission media. As used herein, "tangible computer readable storage medium" and "tangible machine readable storage medium" are used interchangeably. Additionally or alternatively, the example processes of FIGS. 9-14 may be implemented using coded instructions (e.g., computer and/or machine readable instructions) stored on a non-transitory computer and/or machine readable medium such as a hard disk drive, a flash memory, a read-only memory, a compact disk, a digital versatile disk, a cache, a random-access memory and/or any other storage device or storage disk in which information is stored for any duration (e.g., for extended time periods, permanently, for brief instances, for temporarily buffering, and/or for caching of the information). As used herein, the term non-transitory computer readable medium is expressly defined to include any type of computer readable storage device and/or storage disk and to exclude propagating signals and to exclude transmission media. As used herein, when the phrase "at least" is used as the transition term in a preamble of a claim, it is open-ended in the same manner as the term "comprising" is open ended.

Figure 9:
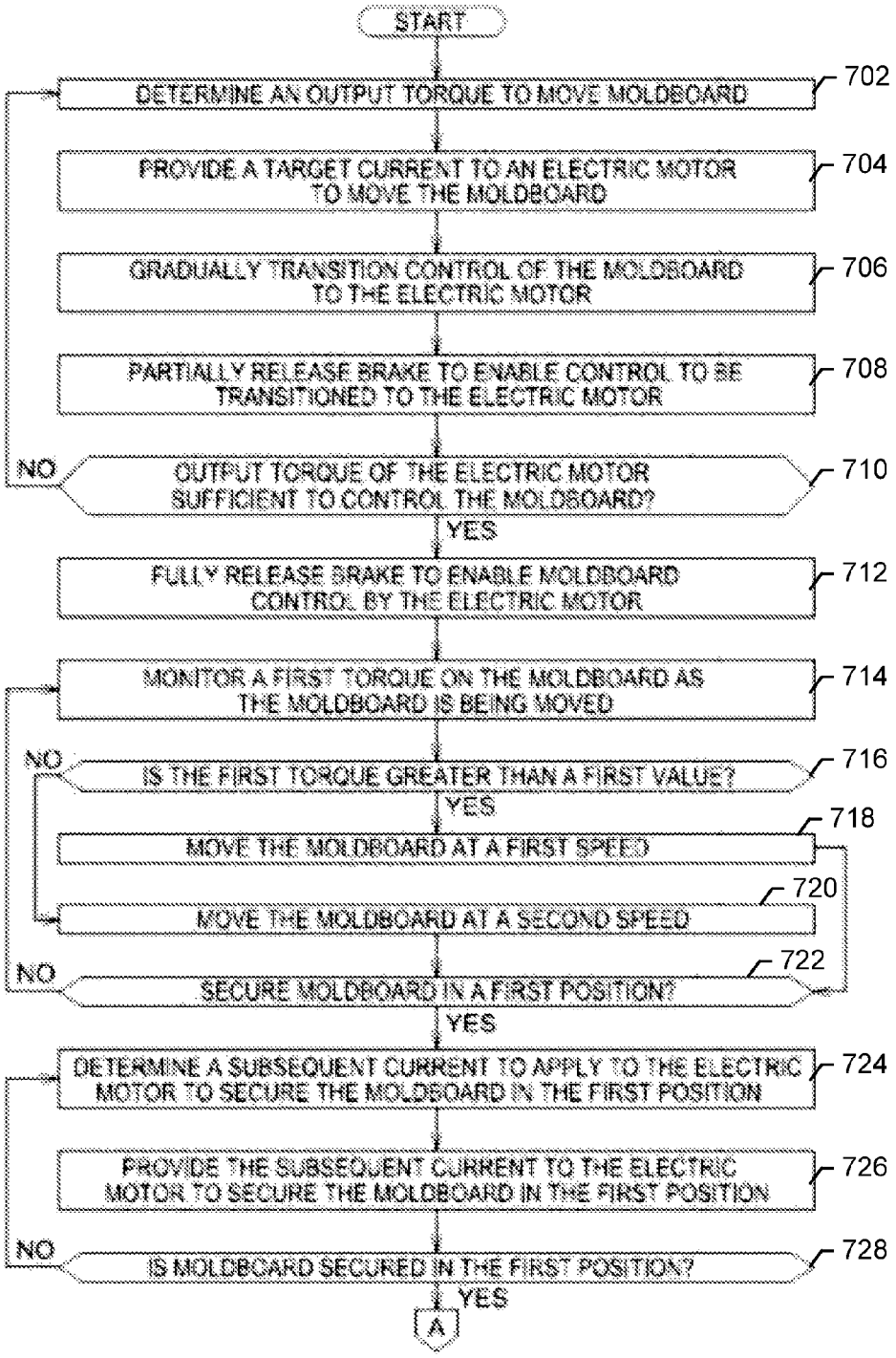
FIGS. 9-14 are flowcharts representative of machine readable instructions that may be executed to implement the example motor grader of FIG. 1 and the examples disclosed herein.

The process of FIG. 9, which may be implemented using, for example, a computer program, includes the processor 132 determining an output torque of the electric motor 304 to smoothly transition and/or move the blade 118 after the brake 308 is released (block 702). A target current is applied to the electric motor 304 to move the blade 118 (block 704). As the electric motor 304 is being provided the target current, control of the blade 118 is gradually transitioned to the electric motor 304 (block 706). For example, control may be transitioned to the electric motor 304 by the brake 308 partially releasing and/or being reapplied and the processor 132 monitoring the output torque of the electric motor 304 (block 708). The processor 132 then determines if the output torque of the electric motor 304 is sufficient to control the blade 118 (block 710). For example, the processor 132 may compare the output torque of the electric motor 304 to the output torque determined at block 702 to verify that the output torque of the electric motor 304 is equal to or greater than the determined output torque. If the output torque of the electric motor 304 is determined to be sufficient to control the blade 118, the brake 308 is fully released to enable control of the blade 118 by the electric motor 304 and, specifically, for the electric motor 304 to move the blade 118 (block 712).

As the blade 118 is being moved, a first torque on the blade 118 and/or exerted by the electric motor 304 is determined using the sensor 307 and/or a look-up table (block 714). The determined torque value is conveyed to the processor 132. The processor 132 determines if the measured and/or determined torque value is greater than a first value (block 716). If the torque value is greater than the first value, the blade 118 is likely engaging the ground and, thus, the processor 132 causes the blade 118 to be moved at a first speed (block 718). If the torque value is less than the first value, the blade 118 is likely not engaging the ground and, thus, the processor 132 causes the blade 118 to be moved at a second speed (block 720).

The processor 132 determines whether the blade 118 is to be secured in a first position (block 722). If the blade is to be secured in the first position, the processor 132 determines a current to apply to the electric motor 304 to secure the blade 118 in the first position (block 724). The current is applied to the electric motor 304 to secure the blade 118 (block 726). As the current is being applied to the electric motor 304, movement of the blade 118 is monitored by the processor 132 to determine if the blade 118 is secured in the first position (block 728).

Figure 10:
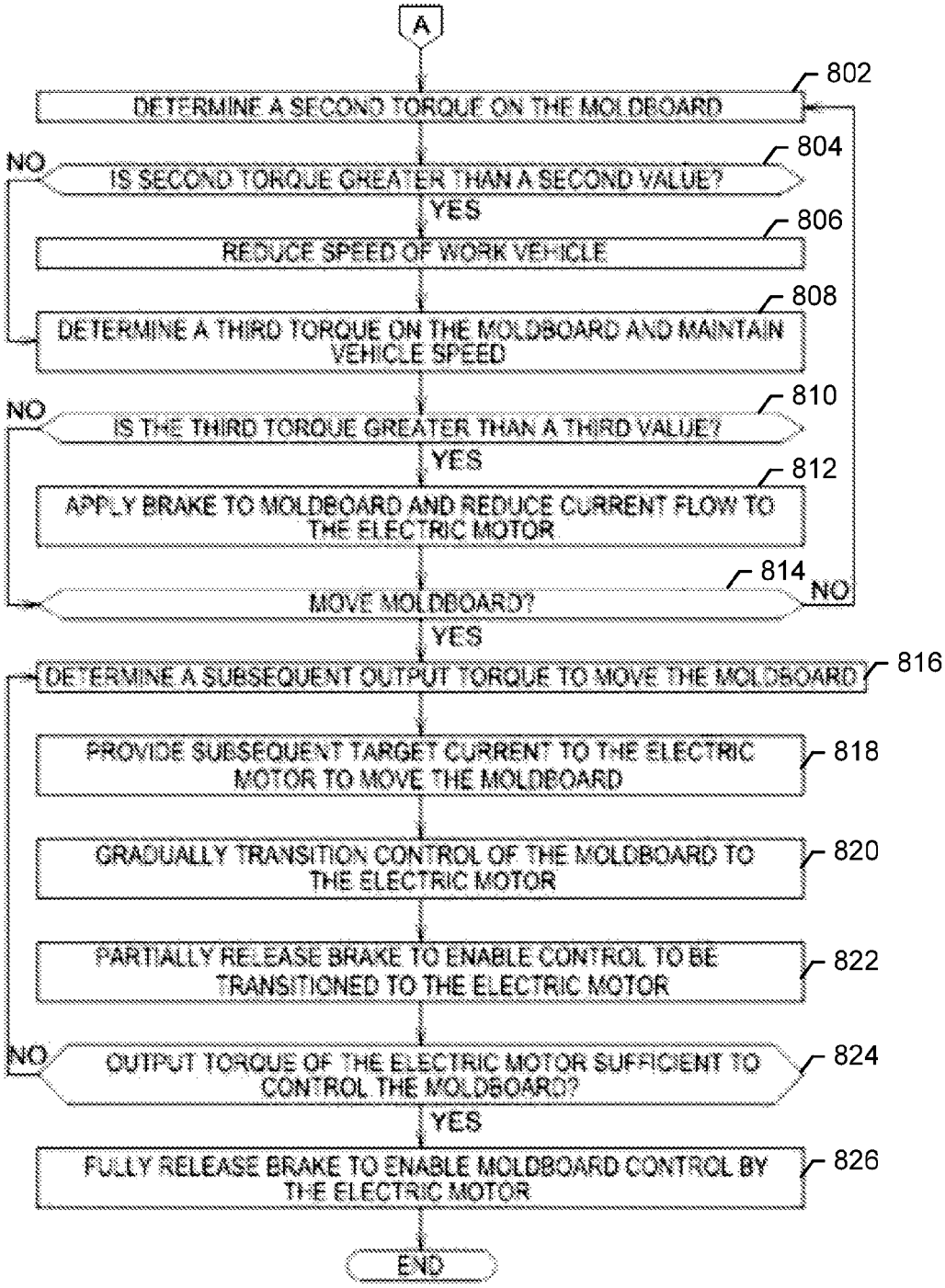

As shown in FIG. 10, if the blade 118 is secured in the first position, a second torque on the blade 118 and/or exerted by the electric motor 304 is determined using the sensor 307 and/or a look-up table (block 802). The determined second torque value is conveyed to the processor 132. The processor 132 determines if the second torque is greater than a second value (block 804). If the amount of torque on the blade 118 exceeds a particular amount, the quality and/or the evenness of the grade of material being graded may decrease. Thus, if the second torque is greater than the second value, at block 806, the speed of the grader 100 is decreased to substantially ensure that the quality of the grade is maintained (block 806).

To ensure that the electric motor 304 does not overheat and/or degrade over time, an amount of stall current applied to the blade 118 by the electric motor 304 is monitored and/or a third torque on the blade 118 and/or exerted by the electric motor 304 is monitored (e.g., using the sensor 307 and/or the look-up table) (block 808). The processor 132 determines if the third torque exceeds a third value (block 810). If the third torque exceeds a third value, the brake 308 is applied to the pinion 302 to secure the blade 118 in position and the processor 132 causes the current flow to the electric motor 304 to decrease (block 812).

The processor 132 determines if the blade 118 is to be moved (block 814). If the blade 118 is to be moved, the processor 132 determines an output torque of the electric motor 304 to smoothly transition the blade 118 after the brake 308 is released (block 816). The current is applied to the electric motor 304 to move the blade 118 (block 818). As the current is being applied to the electric motor 304, control of the blade 118 is gradually transitioned to the electric motor 304 (block 820). For example, control may be transitioned to the electric motor 304 by the brake 308 partially releasing and/or being reapplied and the processor 132 monitoring the output torque of the electric motor 304 (block 822). The processor 132 determines if the output torque of the electric motor 304 is sufficient to control the blade 118 (block 824). For example, the processor 132 may compare the output torque of the electric motor 304 to the output torque determined at block 816 to verify that the output torque of the electric motor 304 is equal to or greater than the determined output torque.

If the output torque of the electric motor 304 is determined to be sufficient to control the blade 118, the brake 308 is fully released to enable control of the blade 118 by the electric motor 304 and, specifically, for the electric motor 304 to move the blade 118 (block 826).

Figure 11:
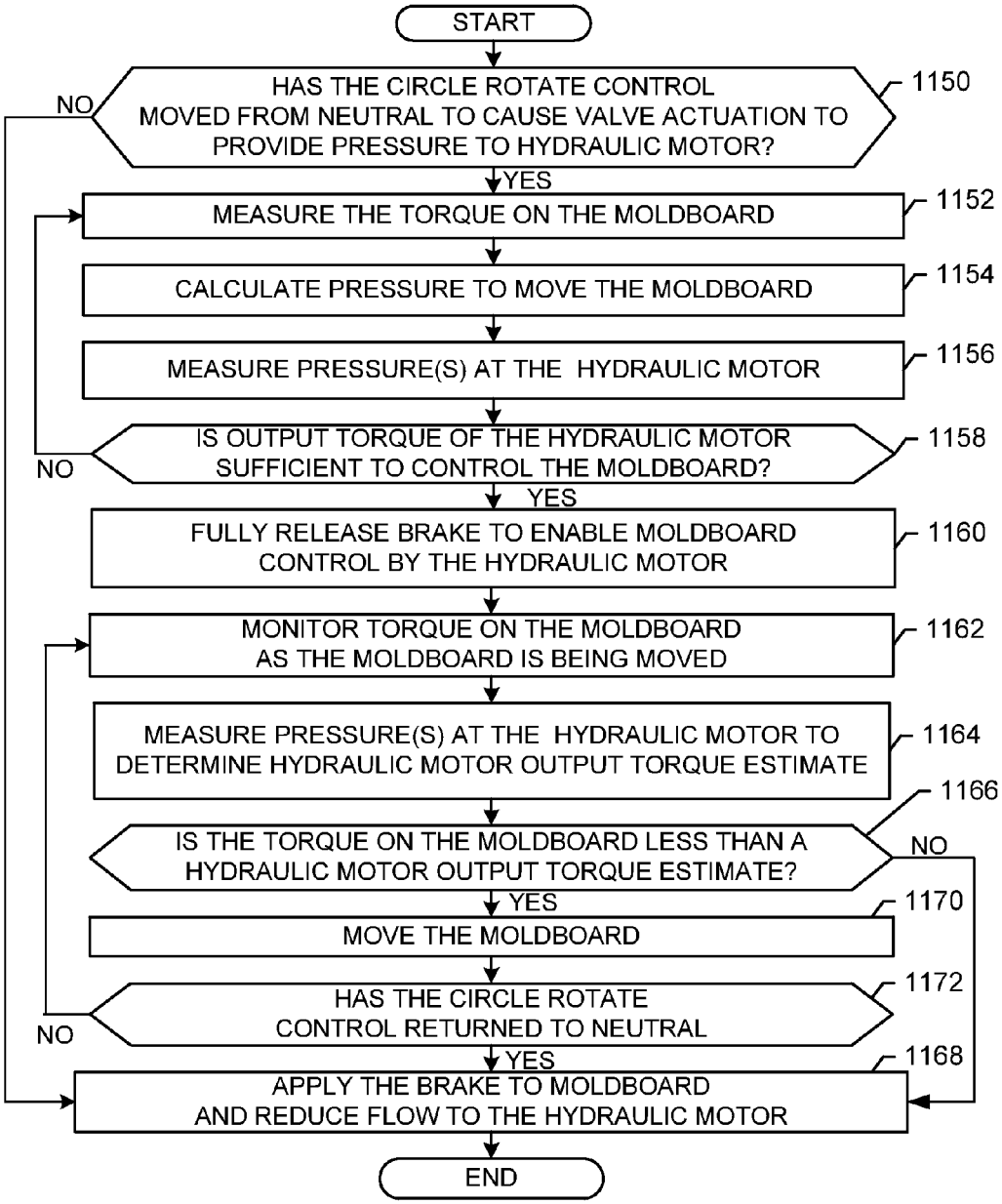

The process of FIG. 11, which may be implemented using, for example, a computer program, begins by the processor 132 determining if an input has been received associated with a circle rotate control being moved from a neutral position (block 1150). The input may be, for example, feedback and/or data received and/or obtained from a sensor that monitors the position of the circle rotate control (e.g., the circle rotate handle). In some examples, the input includes data generated by a sensor that monitors the position of the circle rotate control. Based on the movement of the circle rotate control from the neutral position, a valve is actuated which provides pressure (e.g., hydraulic pressure) to the hydraulic motor 502. Using information received from the sensor 307, the processor 132 determines a torque on the blade 118 (block 1152). Based on the determined torque on the blade 118, the processor 132 determines a pressure for the hydraulic motor 502 to move the blade 118 (block 1154). The processor 132 then causes the pressure sensor(s) 504 to measure the pressure at the hydraulic motor 502 (block 1156). Based on the measured pressure and the torque on the blade 118, the processor 132 determines if the output torque of the hydraulic motor 502 is sufficient to control the blade 118 (block 1158). If the processor 132 determines that the output torque of the hydraulic motor 502 is sufficient to control the blade 118, the brake 308 is released to enable the blade 118 to be controlled by the hydraulic motor 502 (block 1160).

After the brake 308 is released and the hydraulic motor 502 is applying a torque to move the blade 118, the processor 132 causes the sensor 307 to monitor the torque on the blade 118 (block 1162). The processor 132 causes the pressure sensor(s) 504 to measure the pressure at the hydraulic motor 502 to enable the processor 132 to determine an estimated output torque of the hydraulic motor 502 based on the measured pressure (block 1164). The processor 132 determines if the torque on the blade 118 is less than the hydraulic motor output torque estimate (block 1166). If the torque on the blade 118 is greater than an estimated output torque of the hydraulic motor 502, the processor 132 causes the brake 308 to be applied (block 1168). In some examples, after the brake 308 is applied, the operator moves the circle rotate control to the neutral position to reduce the hydraulic pressure to the hydraulic motor 502. However, if the torque on the blade 118 is less than an estimated output torque of the hydraulic motor 502, the hydraulic motor 502 continues to apply an output torque on the blade 118 to move the blade 118 in the desired direction (block 1170). The processor 132 then determines if an input has been received that the circle rotate control has been returned to a neutral position (block 1172). If the processor 132 receives an input that the circle rotate control has been returned to a neutral position indicative that the blade 118 rotation should stop, the processor 132 causes the brake 308 to be applied and the hydraulic pressure to the hydraulic motor 502 decreases (block 1168).

Figure 12:
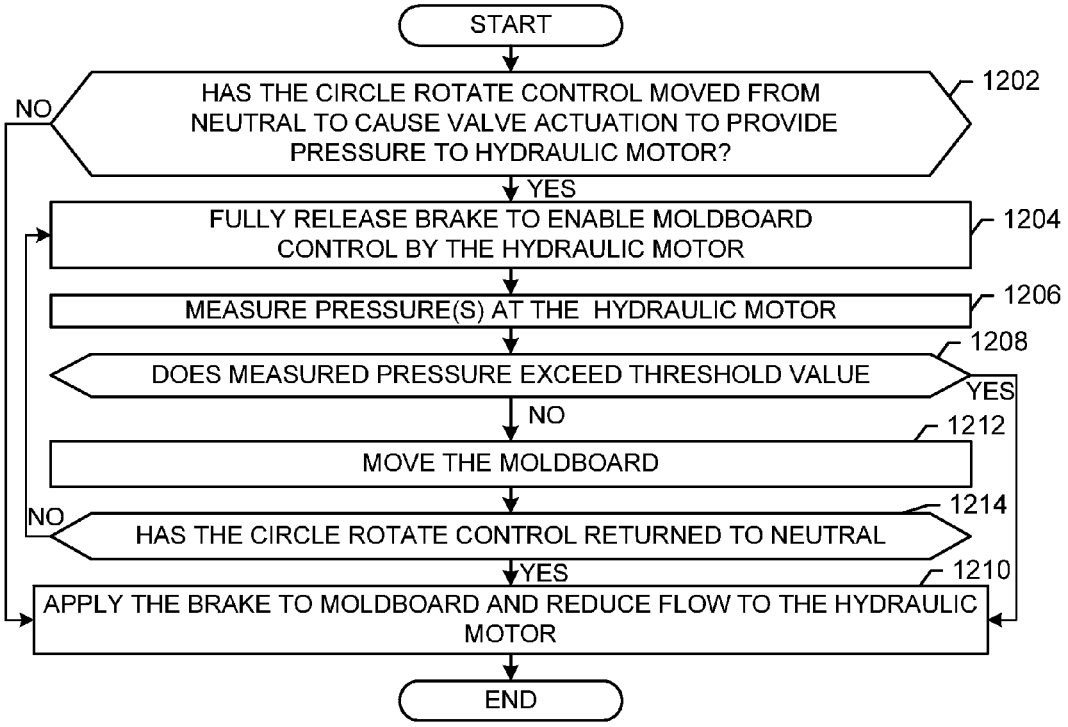

The process of FIG. 12, which may be implemented using, for example, a computer program, begins by the processor 132 determining if an input has been received associated with a circle rotate control being moved from a neutral position (block 1202). The input may be, for example, feedback and/or data received and/or obtained from a sensor that monitors the position of the circle rotate control (e.g., the circle rotate handle). In some examples, the input includes data generated by a sensor that monitors the position of the circle rotate control. Based on the movement of the circle rotate control from the neutral position, a valve is actuated which provides pressure (e.g., hydraulic pressure) to the hydraulic motor 502. Based on the movement of the circle rotate control from the neutral position, the brake 308 is released to enable the blade 118 to be controlled by the hydraulic motor 502 (block 1204).

The processor 132 causes the pressure sensor(s) 504 to measure the pressure at the hydraulic motor 502 (block 1206). Based on the measured pressure, the processor 132 determines if the measured pressure exceeds a particular threshold value (block 1208). Having the measured pressure below the threshold value indicates that the hydraulic motor 502 may be able to control the movement of the blade 118. Having the measured pressure above the threshold value indicates that the hydraulic motor 502 may not be able to control the movement of the blade 118. If the measured pressure is greater than the threshold value, the processor 132 causes the brake 308 to be applied (block 1210). In some examples, after the brake 308 is applied, the operator moves the circle rotate control to the neutral position to reduce the hydraulic pressure to the hydraulic motor 502. However, if the measured pressure is less than the threshold value, the hydraulic motor 502 continues to apply an output torque on the blade 118 to move the blade 118 in the desired direction (block 1212).

The processor 132 then determines if an input has been received that the circle rotate control has been returned to a neutral position (block 1214). If the processor 132 receives an input that the circle rotate control has been returned to a neutral position indicative that the blade 118 rotation should stop, the processor 132 causes the brake 308 to be applied and the hydraulic pressure to the hydraulic motor 502 decreases (block 1210).

Figure 13:
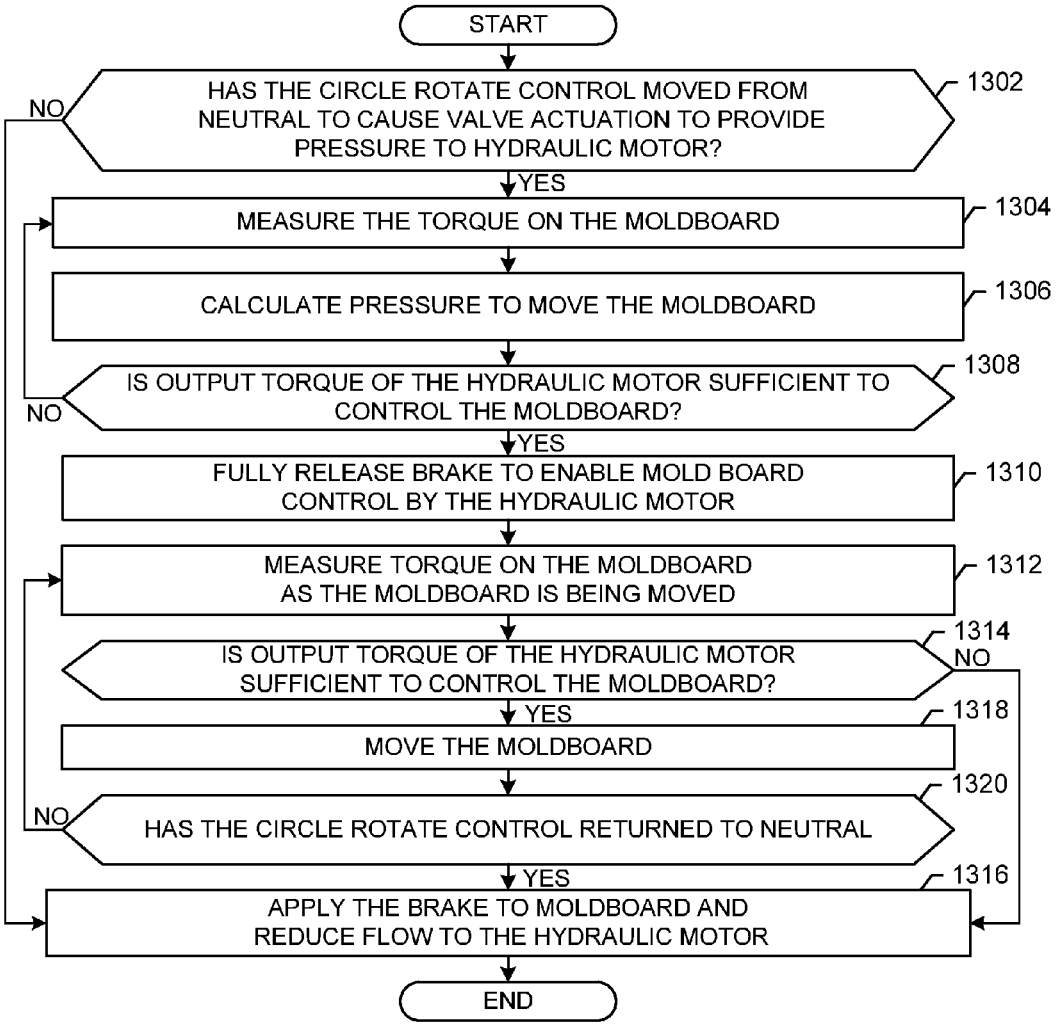

The process of FIG. 13, which may be implemented using, for example, a computer program, begins by the processor 132 determining if an input has been received associated with a circle rotate control being moved from a neutral position (block 1302). The input may be, for example, feedback and/or data received and/or obtained from a sensor that monitors the position of the circle rotate control (e.g., the circle rotate handle). In some examples, the input includes data generated by a sensor that monitors the position of the circle rotate control. Based on the movement of the circle rotate control from the neutral position, a valve is actuated which provides pressure (e.g., hydraulic pressure) to the hydraulic motor 502. Using information received from the sensor 307, the processor 132 determines a torque on the blade 118 (block 1304). Based on the torque on the blade 118, the processor 132 determines a pressure for the hydraulic motor 502 to move the blade 118 (block 1306). Based on the hydraulic pressure within the hydraulic system of the grader 100, the processor 132 determines if the output torque of the hydraulic motor 502 is sufficient to control the blade 118 (block 1308). If the processor 132 determines that the output torque of the hydraulic motor 502 is sufficient to control the blade 118, the brake 308 is released to enable the blade 118 to be controlled by the hydraulic motor 502 (block 1310).

After the brake 308 is released and the hydraulic motor 502 is applying a torque to move the blade 118, the processor 132 causes the sensor 307 to measure the torque on the blade 118 (block 1312). Based on the hydraulic pressure within the hydraulic system of the grader 100 and the torque on the blade 118, the processor 132 determines if the torque on the blade 118 is less than an estimated output torque of the hydraulic motor (block 1314). If the torque on the blade 118 is greater than an estimated output torque of the hydraulic motor 502, the processor 132 causes the brake 308 to be applied (block 1316). In some examples, after the brake 308 is applied, the operator moves the circle rotate control to the neutral position to reduce the hydraulic pressure to the hydraulic motor 502. However, if the torque on the blade 118 is less than an estimated output torque of the hydraulic motor 502, the hydraulic motor 502 continues to apply an output torque on the blade 118 to move the blade 118 in the desired direction (block 1318). The processor 132 then determines if an input has been received that the circle rotate control has been returned to a neutral position (block 1320). If the processor 132 receives an input that the circle rotate control has been returned to a neutral position indicative that the blade 118 rotation should stop, the processor 132 causes the brake 308 to be applied and the hydraulic pressure to the hydraulic motor 502 decreases (block 1316).

Figure 14:
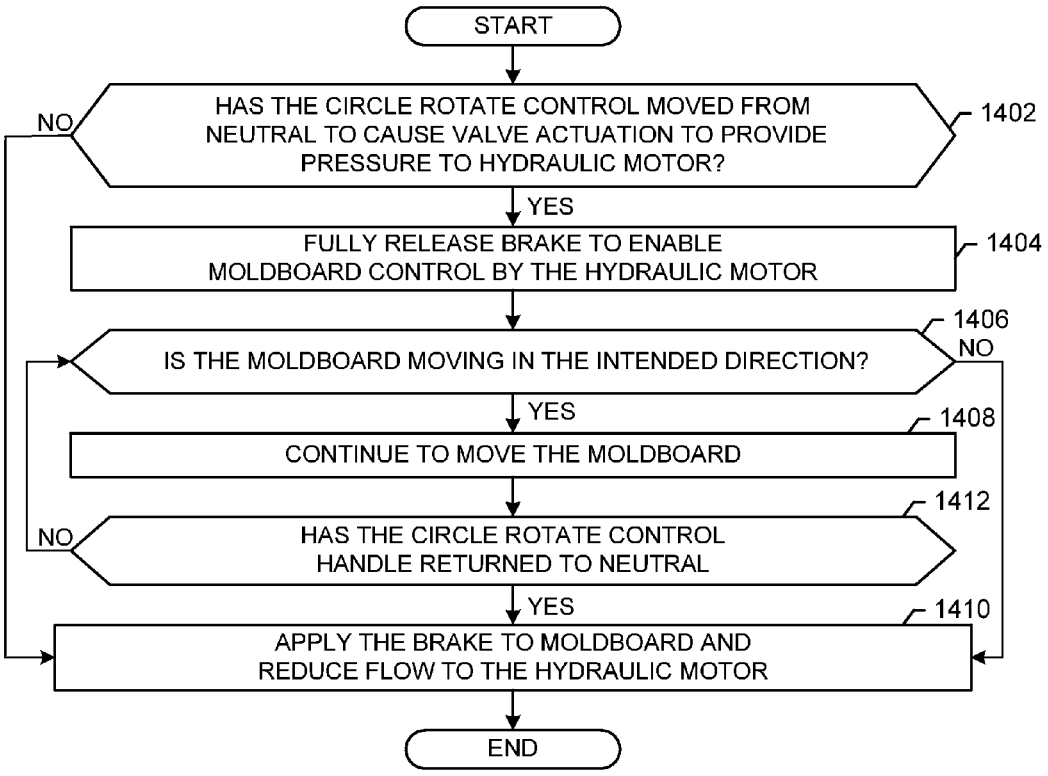

The process of FIG. 14, which may be implemented using, for example, a computer program, begins by the processor 132 determining if an input has been received associated with a circle rotate control being moved from a neutral position indicating that the blade 118 should move in a particular direction (e.g. clockwise, counterclockwise) (block 1402). The input may be, for example, feedback and/or data received and/or obtained from a sensor that monitors the position of the circle rotate control (e.g., the circle rotate handle). In some examples, the input includes data generated by a sensor that monitors the position of the circle rotate control. Based on the movement of the circle rotate control from the neutral position, a valve is actuated which provides pressure (e.g., hydraulic pressure) to the hydraulic motor 502. Based on the movement of the circle rotate control from the neutral position, the brake 308 is released to enable the blade 118 to be controlled by the hydraulic motor 502 (block 1404).

The speed sensor 802 then monitors the direction of the blade 118 and, based on feedback received from the speed sensor 802, the processor 132 determines if the blade 118 is rotating in the intended direction (block 1406). The direction that the operator intends to have the blade 118 rotate is based on the input received from the circle rotate control. If the blade 118 is moving in the intended direction, the hydraulic motor 502 continues to apply an output torque on the blade 118 to move the blade 118 in the desired direction (block 1408). However, if the blade 118 is not moving in the intended direction, the processor 132 causes the brake 308 to be applied (block 1410). In some examples, after the brake 308 is applied, the operator moves the circle rotate control to the neutral position to reduce the hydraulic pressure to the hydraulic motor 502. The processor 132 then determines if an input has been received that the circle rotate control has been returned to a neutral position (block 1412). If the processor 132 receives an input that a circle rotate control has been returned to a neutral position indicative that the blade 118 rotation should stop, the processor 132 causes the brake 308 to be applied and the hydraulic pressure to the hydraulic motor 502 decreases (block 1410).

Figure 15:
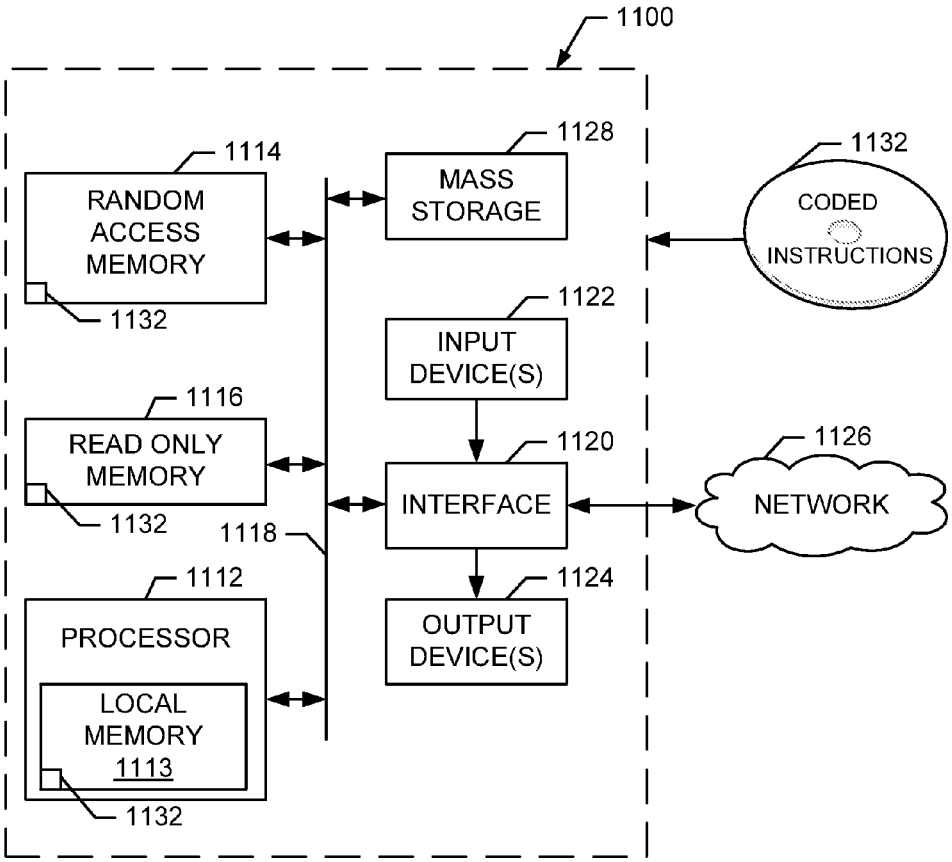
FIG. 15 shows a processor platform to execute the instructions represented in FIGS. 9-14 to implement the example motor grader of FIG. 1.

FIG. 15 is a block diagram of an example processor platform 1100 capable of executing the instructions of FIGS. 9-14 to implement the grader 100. The processor platform 1100 can be, for example, a server, a personal computer, a mobile device (e.g., a cell phone, a smart phone, a tablet such as an iPad™) or any other type of computing device.

The processor platform 1100 of the illustrated example includes a processor 1112. The processor 1112 of the illustrated example is hardware. For example, the processor 1112 can be implemented by one or more integrated circuits, logic circuits, microprocessors or controllers from any desired family or manufacturer.

The processor 1112 of the illustrated example includes a local memory 1113 (e.g., a cache). The processor 1112 of the illustrated example is in communication with a main memory including a volatile memory 1114 and a non-volatile memory 1116 via a bus 1118. The volatile memory 1114 may be implemented by Synchronous Dynamic Random Access Memory (SDRAM), Dynamic Random Access Memory (DRAM), RAMBUS Dynamic Random Access Memory (RDRAM) and/or any other type of random access memory device. The non-volatile memory 1116 may be implemented by flash memory and/or any other desired type of memory device. Access to the main memory 1114, 1116 is controlled by a memory controller.

The processor platform 1100 of the illustrated example also includes an interface circuit 1120. The interface circuit 1120 may be implemented by any type of interface standard, such as an Ethernet interface, a universal serial bus (USB), and/or a PCI express interface.

In the illustrated example, one or more input devices 1122 are connected to the interface circuit 1120. The input device(s) 1122 permit(s) a user to enter data and commands into the processor 1112. The input device(s) can be implemented by, for example, an audio sensor, a microphone, a camera (still or video), a keyboard, a button, a mouse, a touchscreen, a track-pad, a trackball, isopoint and/or a voice recognition system.

One or more output devices 1124 are also connected to the interface circuit 1120 of the illustrated example. The output devices 1124 can be implemented, for example, by display devices (e.g., a light emitting diode (LED), an organic light emitting diode (OLED), a liquid crystal display, a cathode ray tube display (CRT), a touchscreen, a tactile output device). The interface circuit 1120 of the illustrated example, thus, typically includes a graphics driver card, a graphics driver chip or a graphics driver processor.

The interface circuit 1120 of the illustrated example also includes a communication device such as a transmitter, a receiver, a transceiver, a modem and/or network interface card to facilitate exchange of data with external machines (e.g., computing devices of any kind) via a network 1126 (e.g., an Ethernet connection, a digital subscriber line (DSL), a telephone line, coaxial cable, a cellular telephone system, etc.).

The processor platform 1100 of the illustrated example also includes one or more mass storage devices 1128 for storing software and/or data. Examples of such mass storage devices 1128 include floppy disk drives, hard drive disks, compact disk drives, Blu-ray disk drives, RAID systems, and digital versatile disk (DVD) drives.

The coded instructions 1132 of FIGS. 9-14 may be stored in the mass storage device 1128, in the volatile memory 1114, in the non-volatile memory 1116, and/or on a removable tangible computer readable storage medium such as a CD or DVD.

Based on the foregoing, it will be clear that the example apparatus, methods and articles of manufacture relate to motor graders having motors and planetary assemblies that enable the smooth rotation and/or securing of the blade. To secure a blade in a particular position, a stall current may be applied to the motor.

An example work vehicle includes a frame, a circle drive coupled to the frame, a moldboard coupled to the circle drive and a planetary gear apparatus including an output shaft configured to mesh with the circle drive to rotate the circle drive relative to the frame. In some examples, the work vehicle also includes a motor coupled to the planetary gear apparatus. In some examples, the work vehicle also includes a power source coupled to the frame, the power source to provide power to the motor. In some examples, the work vehicle also includes a combustion engine coupled to the frame to provide power to the work vehicle. In some examples, the combustion engine is coupled to a first end of the frame and the power source is coupled to a second end of the frame opposite the first end. In some examples, the planetary gear apparatus comprises first planetary gears and second planetary gears, the first planetary gears to provide a first gear reduction and the second planetary gears to provide a second gear reduction.

An example method includes providing a first current to an electric motor to move a moldboard of a work vehicle, the electric motor coupled to the moldboard via a planetary gear apparatus. The example method also includes providing a second current to the electric motor to secure the moldboard in a first position. The example method also includes monitoring a first output torque of the electric motor and, based on the monitoring, applying a brake to the moldboard and reducing the current flow to the electric motor when the output torque is greater than a predetermined value. In some examples, the method also includes determining a second torque to move the moldboard from the first position. In some examples, the method also includes providing a third current to the electric motor to enable the electric motor to output the determined second torque. In some examples, the method also includes, when the electric motor outputs the second torque, releasing the brake.

In some examples, the third current is substantially the same as the second current. In some examples, the work vehicle also includes monitoring a second output torque of the electric motor when the first current is being provided to the electric motor. In some examples, the method also includes determining the second output torque in substantially real time. In some examples, the second torque corresponds to a position of the moldboard relative to the ground. In some examples, the method also includes modifying the speed with which the electric motor moves the moldboard based on a torque on the moldboard. In some examples, the electric motor moves the moldboard at a first speed when the torque on the moldboard is below a first torque, the electric motor moves the moldboard at a second speed lower than the first speed when the torque on the moldboard is above a second torque. In some examples, the first torque is equal to the second torque. In some examples, the method also includes releasing the brake when a second output torque of the electric motor is substantially the same as the torque on the moldboard. In some examples, the method also includes monitoring a second torque on the moldboard when the second current is being provided to the electric motor. In some examples, the method also includes automatically reducing a speed of the work vehicle based on the second torque being above a predetermined torque.

An example method includes receiving an input that a circle rotate control is positioned in a non-neutral position and monitoring at least one of a pressure of a hydraulic motor, a torque on a moldboard, or a direction that the moldboard is moving, the hydraulic motor coupled to the moldboard via a planetary gear apparatus. The method also includes, based on the monitoring, applying a brake to the moldboard when the least one of the pressure, the torque on the moldboard, or the direction that the moldboard is moving is different or greater than a particular value. In some examples, the particular value includes the direction that the moldboard is to rotate based on the input. In some examples, the method also includes automatically reducing a speed of the work vehicle when the least one of the pressure, the torque on the moldboard, or the direction that the moldboard is moving is different or greater than the particular value.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. A work vehicle, comprising:

a frame;

a circle drive coupled to the frame;

a moldboard coupled to the circle drive; and a planetary gear apparatus including an output shaft configured to mesh with the circle drive to rotate the circle drive relative to the frame.

2. The work vehicle of claim 1, further including a motor coupled to the planetary gear apparatus.

3. The work vehicle of claim 2, further including a power source coupled to the frame, the power source to provide power to the motor.

4. The work vehicle of claim 3, further including a combustion engine coupled to the frame to provide power to the work vehicle.

5. The work vehicle of claim 4, wherein the combustion engine is coupled to a first end of the frame and the power source is coupled to a second end of the frame opposite the first end.

6. The work vehicle of claim 1, wherein the planetary gear apparatus includes first planetary gears and second planetary gears, the first planetary gears to provide a first gear reduction and the second planetary gears to provide a second gear reduction.

7. A method, comprising:

providing a first current to an electric motor to move a moldboard of a work vehicle, the electric motor coupled to the moldboard via a planetary gear apparatus;

providing a second current to the electric motor to secure the moldboard in a first position;

monitoring a first output torque of the electric motor; and based on the monitoring, applying a brake to the moldboard and reducing the current flow to the electric motor when the first output torque is greater than a predetermined value.

8. The method of claim 7, further including determining a second torque to move the moldboard from the first position.

9. The method of claim 8, further including providing a third current to the electric motor to enable the electric motor to output the determined second torque.

10. The method of claim 9, further including, when the electric motor outputs the second torque, releasing the brake.

11. The method of claim 9, wherein the third current is substantially the same as the second current.

12. The method of claim 7, further including monitoring a second output torque of the electric motor when the first current is being provided to the electric motor.

13. The method of claim 12, further including determining the second output torque in substantially real time.

14. The method of claim 12, wherein the second output torque corresponds to a position of the moldboard relative to the ground.

15. The method of claim 7, further including modifying the speed with which the electric motor moves the moldboard based on a torque on the moldboard.

16. The method of claim 15, wherein the electric motor moves the moldboard at a first speed when the torque on the moldboard is below a first torque, the electric motor moves the moldboard at a second speed lower than the first speed when the torque on the moldboard is above a second torque.

17. The method of claim 16, wherein the first torque is equal to the second torque.

18. The method of claim 7, further including releasing the brake when a second output torque of the electric motor is substantially the same as a torque on the moldboard.

19. The method of claim 7, further including monitoring a second torque on the moldboard when the second current is being provided to the electric motor.

20. The method of claim 19, further including automatically reducing a speed of the work vehicle based on the second torque being above a predetermined torque.

21. A method, comprising:

receiving an input indicative of a circle rotate control being positioned in a non-neutral position;

monitoring at least one of a pressure of a hydraulic motor, a torque on a moldboard, or a direction that the moldboard is moving, the hydraulic motor coupled to the moldboard via a planetary gear apparatus; and based on the monitoring, applying a brake to the moldboard when the least one of the pressure, the torque on the moldboard, or the direction that the moldboard is moving is different or greater than a particular value.

22. The method of claim 21, wherein the particular value includes the direction that the moldboard is to rotate based on the input.

23. The method of claim 21, further including automatically reducing a speed of the work vehicle when the least one of the pressure, the torque on the moldboard, or the direction that the moldboard is moving is different or greater than the particular value.

24. The method of claim 21, wherein the input includes data generated by a sensor that monitors the position of the circle rotate control.

* * * * *